US007597241B2

(12) United States Patent
Valenzuela et al.

(10) Patent No.: US 7,597,241 B2
(45) Date of Patent: Oct. 6, 2009

(54) CONTAINER WITH HOLD-OPEN FLAPS FOR VENTILATION

(75) Inventors: Juan Z Valenzuela, Rancagua (CL); Carlos A Gajardo, Buin (CL)

(73) Assignee: International Paper, Loveland, OH (US)

( * ) Notice: Subject to any disclaimer, the term of this patent is extended or adjusted under 35 U.S.C. 154(b) by 626 days.

(21) Appl. No.: 11/377,923

(22) Filed: Mar. 16, 2006

(65) Prior Publication Data

US 2006/0213958 A1 Sep. 28, 2006

Related U.S. Application Data

(60) Provisional application No. 60/662,970, filed on Mar. 18, 2005.

(51) Int. Cl.

| | |
|---|---|
| ***B65D 5/00*** | (2006.01) |
| ***B65D 43/12*** | (2006.01) |
| ***B65D 43/20*** | (2006.01) |
| ***B65D 43/00*** | (2006.01) |
| ***B65D 5/38*** | (2006.01) |

(52) U.S. Cl. ..... 229/120; 229/178; 229/915; 229/125.12; 229/171; 229/125; 229/125.125; 229/129.1

(58) Field of Classification Search ..... 229/120, 229/171, 178, 915, 125, 125.12, 125.125, 229/129.1

See application file for complete search history.

(56) References Cited

U.S. PATENT DOCUMENTS

| | | | | |
|---|---|---|---|---|
| 2,295,141 | A * | 9/1942 | Van Wingen | 229/174 |
| 3,568,877 | A * | 3/1971 | Mastrud, Jr. | 229/122 |
| 4,339,036 | A | 7/1982 | Jensen | |
| 5,163,609 | A | 11/1992 | Muise, Jr. | |
| 5,325,602 | A | 7/1994 | Nainis et al. | |
| 5,839,651 | A * | 11/1998 | Teags et al. | 229/125.32 |
| 6,640,975 | B2 * | 11/2003 | Bennett et al. | 206/509 |

FOREIGN PATENT DOCUMENTS

| | | | |
|---|---|---|---|
| FR | 2605596 | A1 * | 4/1988 |
| GB | 2220195 | A * | 1/1990 |

* cited by examiner

*Primary Examiner*—Gary E Elkins
*Assistant Examiner*—Latrice Byrd
(74) *Attorney, Agent, or Firm*—Matthew M. Eslami

(57) ABSTRACT

The present invention provides a container having a carton and a cover sized to fit over and enclose an interior space of the container. Carton and cover each are adapted to permit controlled flow of air in to and out of the interior space of the container. In a preferred embodiment of the present invention, cover sidewalls are adapted to move between an open position and a closed position, wherein air is permitted to flow in to and out of the interior space of the container when the sidewalls are in an open position, but inhibited from flowing in to and out of the container when the sidewalls are in a closed position.

25 Claims, 10 Drawing Sheets

CONTAINER WITH HOLD-OPEN FLAPS FOR VENTILATION

BACKGROUND OF THE INVENTION

1. Technical Field of the Invention

The present invention relates to containers for shipping and storing items, such as meat, produce, dairy and other food articles requiring refrigeration and/or freezing. More particularly, the present invention relates to a container for shipping and storing items, such as meat, produce, dairy and other food articles requiring refrigeration and/or freezing, wherein the container is adapted to permit ventilation in to and out of the container, thereby facilitating refrigeration, freezing, defrosting and/or thawing.

2. Brief Description of the Related Art

Food items, such as meat, produce and dairy, require refrigeration and/or freezing during the various stages of transportation in the supply chain. For example, slaughter houses and other large bulk meat processing plants oftentimes ship large frozen portions of meat to distribution centers, butcher shops, grocery stores and delicatessens for further processing, packaging, delivery and sale to consumers. It is desirable to provide a container for shipping food items, such as meat, produce and dairy, which require refrigeration and/or freezing prior to, during or after shipping.

Corrugated shipping containers are used typically to ship the meat items, wherein the meat items have been wrapped in plastic bags to keep the moisture of the meat from damaging the corrugated material of the shipping container. Corrugated containers also provide an easy-to-stack storage option, thereby facilitating efficient and controlled shipping of large quantities of food items. Several containers may be placed in a stacked, side-by-side orientation on a pallet, and the entire stack of containers thereafter shrink-wrapped for delivery as a single large unit. It is desirable, therefore, to provide a container for shipping food items, wherein multiple containers may be placed in a stacked arrangement for ease of shipping, delivery and storage.

It is common for the shipping containers to be large enough so that several bags of meat can be placed within a single corrugated shipping container, which is then covered prior to shipment. During shipment, it is desirable for the individual shipping containers to be completely enclosed so as to prevent damage to the meat contained therein. Covering the containers also provides thermal insulation, thereby slowing the thawing process. Typical containers used to ship food items include an open-top carton portion and a cover portion which at least partially covers, such as by telescoping over, the open top of the carton portion. It is desirable, therefore, to provide a container for shipping food items, wherein the container may to opened for packing, wherein the container may be closed for shipping, delivery and storage and wherein the container may be reopened for unpacking, handling and dispensing of the food items from the container.

Typically, the meat is placed within one or more plastic bags prior to freezing and the bags of meat are then placed in corrugated containers. The containers are then placed within a large freezing unit and thereafter subjected to sufficiently low temperatures for an elongated period of time during which the meat is frozen while in the bags/containers. It has been discovered that due to the thermal insulating properties of typical prior art containers, it is desirable to not place the cover over the carton until after the meat is frozen. Having the meat placed within such an open-top container during the freezing process facilitates a speedy freezing step. However, this then requires additional undesirable steps during the packing and freezing operations. For example, covers must be stored separately from the cartons (into which the bags of meat have been packed) and thereafter placed over the cartons once the freezing step is complete. It is desirable, therefore, to provide an enclosable container adapted to be used to freeze food items wherein the cover of the container may be closed after the carton has been packed and prior to the freezing step.

It is furthermore desirable to provide an enclosable container adapted to be used to ship products requiring freezing, refrigeration or ventilation of an interior space of the container for at least a portion of the packing, shipping, storing or dispensing operations.

SUMMARY OF THE INVENTION

According to one aspect of the present invention, a container is provided for shipping food items, such as meat, dairy and produce, which require refrigeration, freezing and/ore ventilation prior to, during or after shipping.

It is an object of the present invention to provide a container for shipping food items, such as meat, produce and dairy, which require refrigeration and/or freezing prior to, during or after shipping.

It is another object of the present invention to provide a container for shipping food items, wherein multiple containers may be placed in a stacked arrangement for ease of shipping, delivery and storage.

It is still another object of the present invention to provide a container for shipping food items, wherein the container may to opened for packing and wherein the container may be closed for shipping, delivery and storage.

It is yet another object of the present invention to provide an enclosable container adapted to be used to freeze food items wherein the cover of the container may be closed after the carton has been packed and prior to the freezing step.

It is still another objective of the present invention to provide an enclosable container adapted to be used to ship products requiring freezing, refrigeration or ventilation of an interior space of the container for at least a portion of the packing, shipping, storing or dispensing operations.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

A container according to one aspect of the present invention comprises a carton having a bottom wall, sidewalls and endwalls, at least one of the carton endwalls having an opening; a cover having a top wall, sidewalls and endwalls sized to fit over the carton to define an interior space of the container, at least one of the cover endwalls having an opening therein, at least a portion of the cover endwall opening being aligned with at least a portion of the carton endwall opening when the cover is fit over the carton; wherein at least one of the cover sidewalls is movable between an open position and a closed position; and, wherein the cover sidewalls includes a flap that substantially covers both the cover endwall opening and the carton endwall opening so as to inhibit fluid flow in to and out of the interior space of said container when the cover sidewall is in the closed position.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

Figure 1:
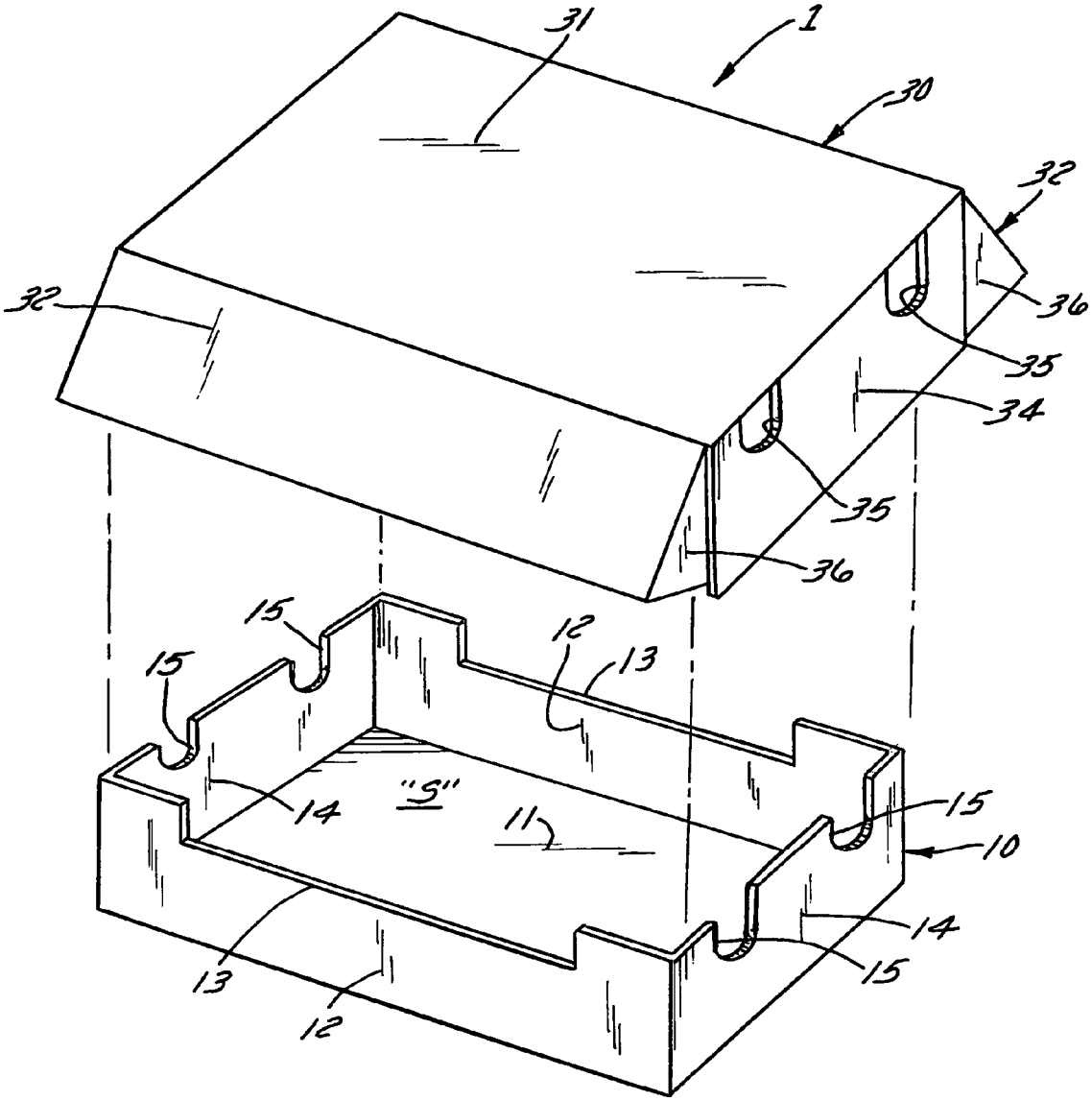
FIG. 1 is an exploded schematic perspective view of the container according to the present invention.

With reference to FIG. 1, a container 1 according to one aspect of the present invention is shown schematically, wherein the container 1 includes an open top carton portion 10 having a bottom wall 11, a pair of opposing sidewalls 12 and a pair of opposing endwalls 14. Sidewalls 12 each include one or more windows 13 and endwalls 14 each include one or more openings 15. Although a four-wall container is shown as an exemplary embodiment of the present invention, those of ordinary skill in the art will understand, upon reading the within description, that the present invention may be readily adapted to be used in connection with containers having any exterior configuration.

Container 1 further includes a cover portion 30 sized and shaped to fit over and telescope with carton 10 and includes a top wall 31, a pair of opposing sidewalls 32 and a pair of opposing endwalls 34. When the cover 30 is placed over the carton 10, cover sidewalls 32 are positioned next to carton sidewalls 12 and cover endwalls 14 are positioned next to carton endwalls 14. Carton bottom wall 11, cover top wall 31, sidewalls 12, 32 and endwalls 14, 34 cooperate to define an enclosed interior space "S" sized for storing one or more items (not shown), such as food items, for example, meat, dairy or produce. Although exemplary embodiments of the present invention are described with reference to storing food items, those of ordinary skill in the art will understand, upon reading the within description, that the present invention may be adapted to provide a container suitable for shipping and storing any article therein which requires freezing, refrigeration or ventilation to greater or lesser extents.

One or both of the cover sidewalls 32 is hingedly connected to the top wall 31 and can thereby be moved between an open position (as shown) and a closed position (FIG. 12), wherein cover sidewalls 32 lie against carton sidewalls 12. When in the open position, cover sidewalls 32 permit the flow of air (or other gas) in to and out of the interior space "S" of the container 1 from below, between the cover sidewalls 32 and the carton sidewalls 12 and through windows 13.

Cover endwalls 34 each include one or more openings 35 which are positioned thereon to align with carton openings 15 when the cover 30 is placed over the carton 10. One or both of the cover sidewalls 32 includes one or more wings 36 extending perpendicularly therefrom towards one of the endwalls 34. Each wing 36 is shaped such that at least a portion of the wing 36 covers one or more of the openings 35 when the sidewall 32 is in a closed position and such that the wing 36 slides away from one or more of the openings 35 when the sidewall is in an open position, thereby permitting the flow of air (or other gas) in to and out of the interior space "S" of the container 1 from its ends, through open cover endwall openings 35 and through carton endwall openings 15.

It will be obvious to those of ordinary skill in the art, upon reading the within disclosure, that air (or other gas) is permitted to flow in to and out of the interior space "S" of the container 1 from the sides (though windows 13) and from the ends (through openings 15, 35). Refrigeration and/or freezing of items (not shown) contained within the interior space "S" of the container 1, then, is facilitated by allowing cold (or warm, as the case may be) air to flow directly therethrough, even when the cover 30 is placed over the carton 10, such as, after packing the container 1 with food items (not shown).

Figure 2:
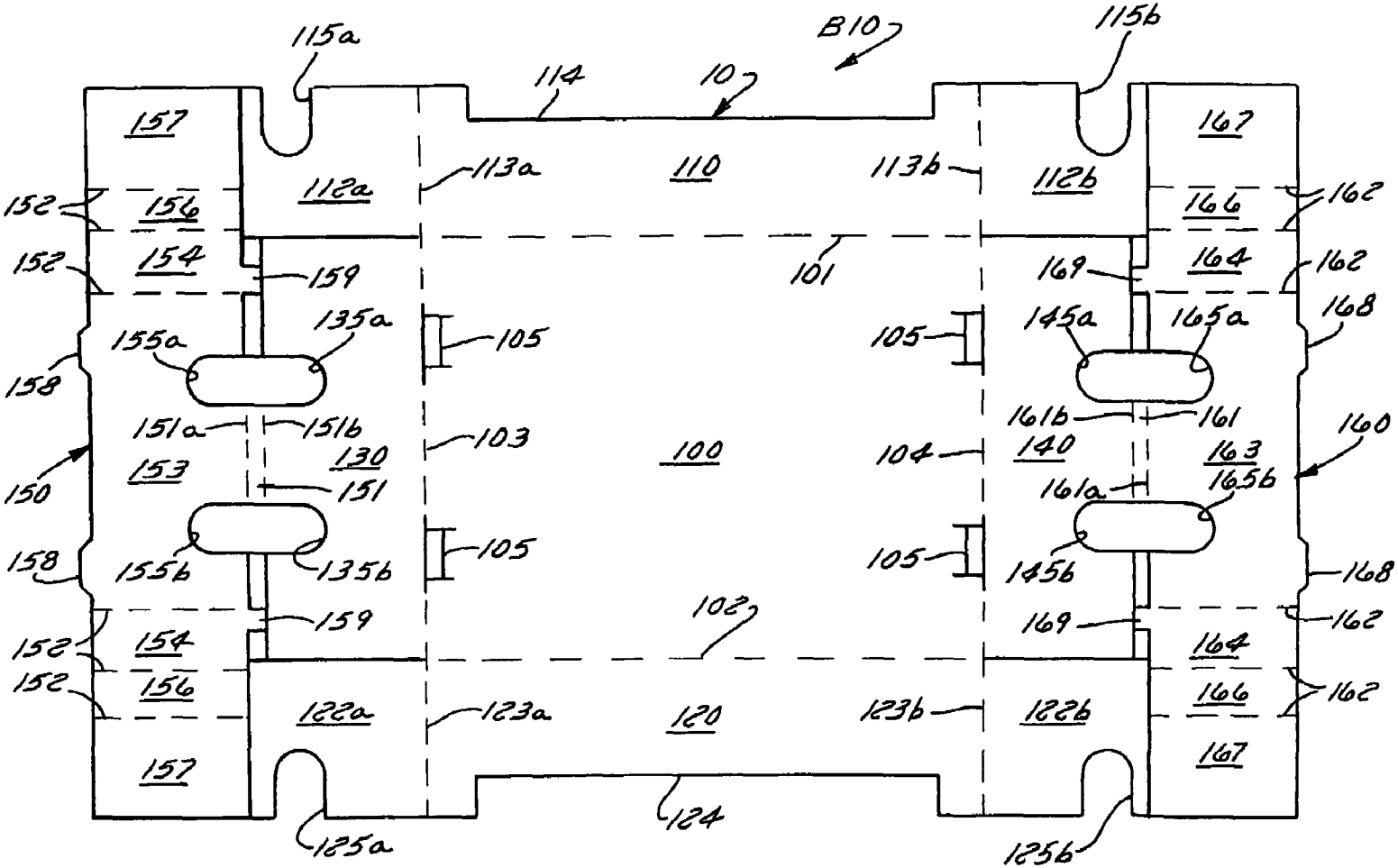
FIG. 2 is a plan view of a blank used to form a bottom portion of a container according to a preferred embodiment of the present invention.

Referring now to FIG. 2, a blank "B10" is shown adapted to be formed (such as by folding) into the carton 10 portion (FIG. 1) of the container 1 according to one specific preferred embodiment of the present invention. The blank "B10" is formed from a sheet of foldable material such as corrugated paperboard or the like and is generally rectangular in shape. Blank "B10" is divided by fold lines, score lines and slits to define panels which are foldable relative to one another (as described in greater detail herein) to form the carton 10 portion of the container 1.

Blank "B10" includes a bottom panel 100 generally centered thereon. A first sidewall panel 110 is foldably connected to a first side edge of the bottom panel 100 by a first side fold line 101. First sidewall panel 110 includes end flaps 112*a*, 112*b* foldably connected to distal ends of the first sidewall panel 110 by end flap fold lines 113*a*, 113*b*, respectively. First sidewall panel 110 also includes a first window 114. End flaps 113*a*, 113*b* each include a cutout 115*a*, 115*b*.

A second sidewall panel 120 is foldably connected to a second side edge of the bottom panel 100 by a second side fold line 102. Second sidewall panel 120 includes end flaps 122*a*, 122*b* foldably connected to distal ends of the second sidewall panel 120 by end flap fold lines 123*a*, 123*b*, respectively. Second sidewall panel 120 also includes a second window 124. End flaps 123*a*, 123*b* each include a cutout 125*a*, 125*b*.

A first endwall outer panel 130 is foldably connected to a first end edge of the bottom panel 100 by a first end fold line 103. A first endwall inner panel 150 is foldably connected to a center section 133 of an outer edge of the first endwall outer panel 130 by a bridge segment 151, which in a preferred embodiment of the present invention is formed by a pair of generally parallel fold lines 151*a*, 151*b*. First endwall inner panel 150 is divided by generally parallel fold lines 152 into a center panel section 153, a pair of interior support-forming flaps 154, a pair of exterior support-forming flaps 156 and a pair of distal flaps 157. Cutouts 135*a*, 135*b* are provided at each end of the center section 133 of the first endwall outer panel 130 and cutouts 155*a*, 155*b* are provided at each end of the center panel section 153 of the first endwall inner panel 150. Each cutout 135*a*, 135*b* of the first endwall outer panel 130 is aligned generally with cutouts 155*a*, 155*b*, respectively, of the first endwall inner panel 150.

A second endwall outer panel 140 is foldably connected to a second end edge of the bottom panel 100 by a second end fold line 104. A second endwall inner panel 160 is foldably connected to a center section 143 of an outer edge of the second endwall outer panel 140 by a bridge segment 161, which in a preferred embodiment of the present invention is formed by a pair of generally parallel fold lines 161*a*, 161*b*. Second endwall inner panel 160 is divided by generally parallel fold lines 162 into a center panel section 163, a pair of interior support-forming flaps 164, a pair of exterior support-forming flaps 166 and a pair of distal flaps 167. Cutouts 145*a*, 145*b* are provided at each end of the center section 143 of the second endwall outer panel 140 and cutouts 165*a*, 165*b* are provided at each end of the center panel section 163 of the second endwall inner panel 160. Each cutout 145*a*, 145*b* of the first endwall outer panel 140 is aligned generally with cutouts 165*a*, 165*b*, respectively, of the first endwall inner panel 160.

Slots 105 are provided in the bottom wall 100 along first and second end fold lines 103, 104, respectively. Tabs 158, 168 are provided along an outer edge of the first and second endwall inner panels 150, 160, respectively.

Figure 3:
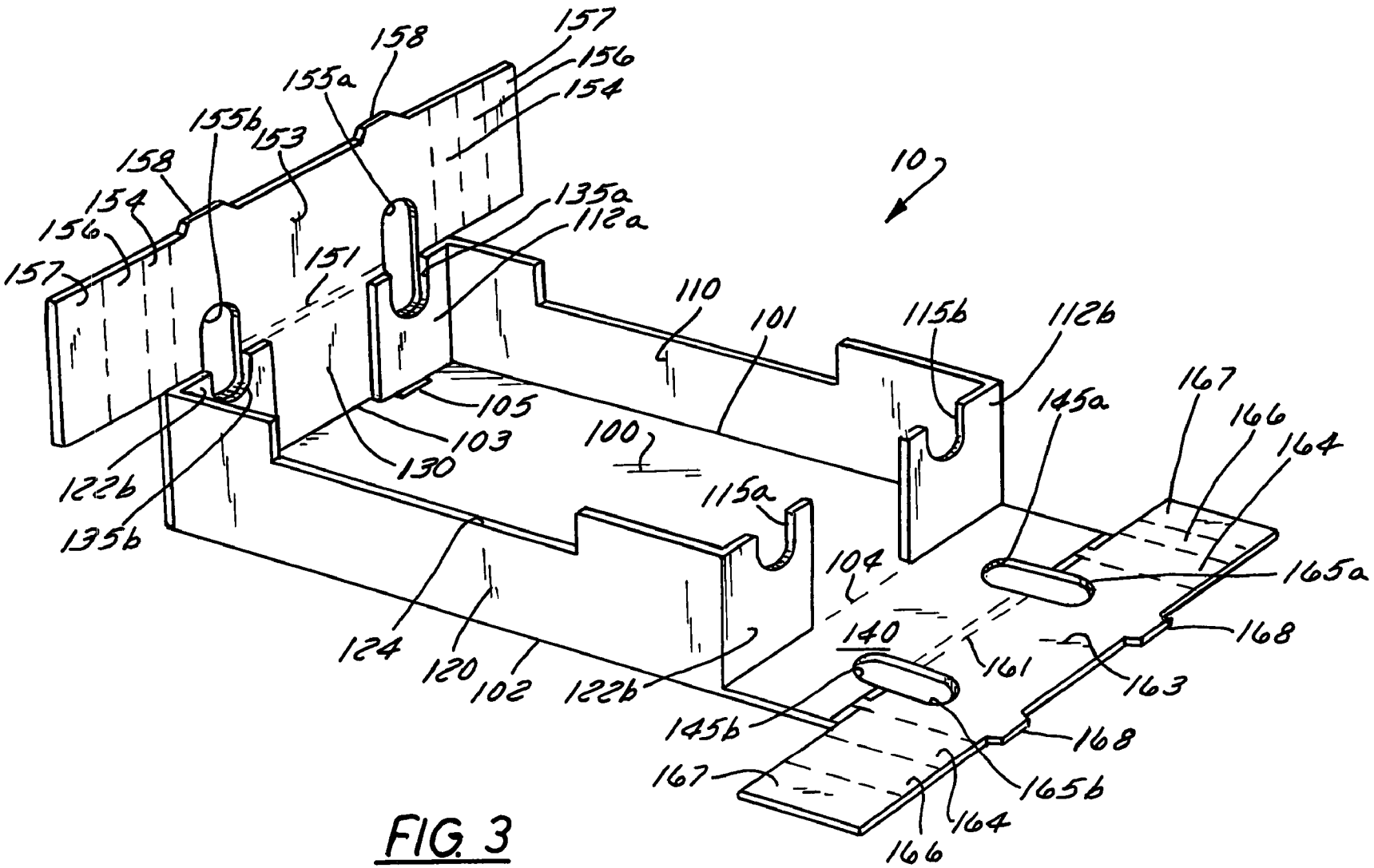
FIG. 3 is a perspective view of the blank shown in FIG. 2, wherein portions of the blank have been folded to partially form the bottom portion of the container according to a preferred embodiment of the present invention.

With reference now to FIG. 3, blank "B10" is folded to form carton 10 portion of the container 1 by folding sidewalls 110, 120 upwardly relative to fold lines 101, 102, respectively, such that sidewalls 110, 120 are generally perpendicular to bottom panel 100. Sidewall end flaps 112*a*, 112*b*, 122*a*, 122*b* are folded relative to sidewalls 110, 120, respectively, to form corners of the carton 10. Endwall outer panels 130, 140 are then folded upwardly relative to fold lines 103, 104, respectively, and endwall inner panels 150, 160 are folded inwardly over sidewall end flaps 112*a*, 122*a* and 112*b*, 122*b*, respectively. Tabs 158, 168 seat within slots 105 in the bottom wall 100 to retain endwall panels 130, 140, 150, 160 in place. Sidewall end flaps 112*a*, 122*a*, 112*b*, 122*b* are thereby held securely between endwall outer panels 130, 140 and endwall inner panels 153, 163, respectively.

Figure 4:
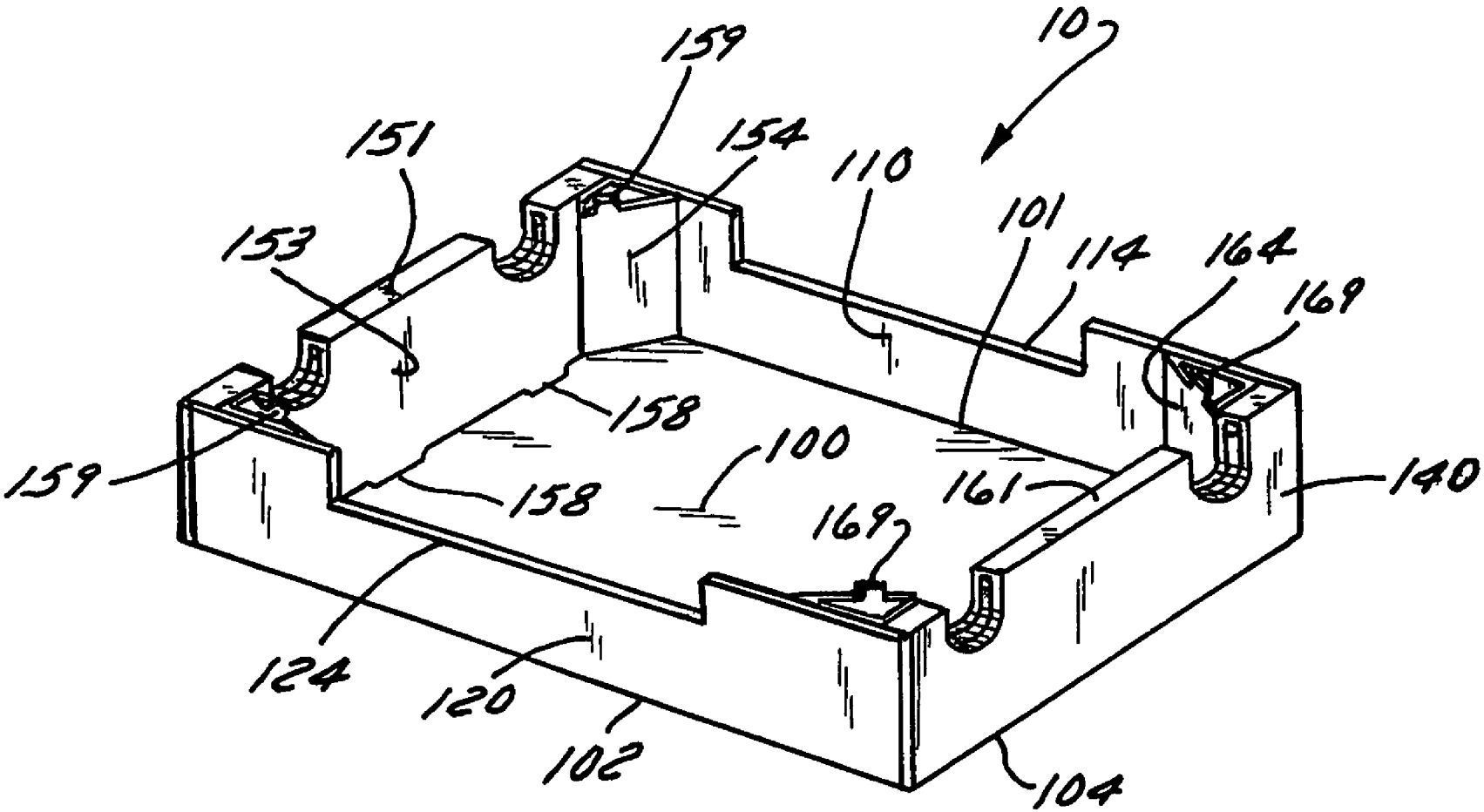
FIG. 4 is a perspective view of the blank shown in FIG. 2, wherein the blank has been folded to form the bottom portion of the container according to a preferred embodiment of the present invention.
Figure 5:
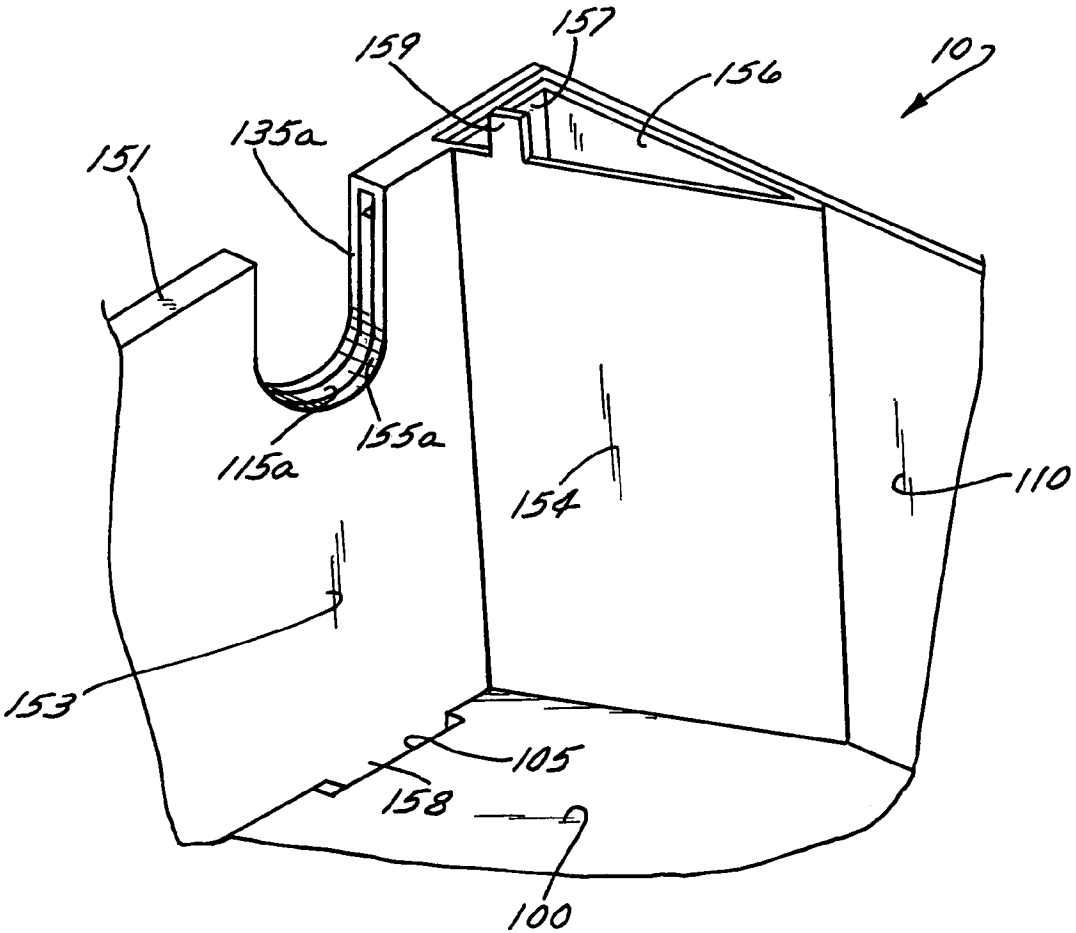
FIG. 5 is a partial perspective view of one corner of the bottom portion of the container according to a preferred embodiment of the present invention.
Figure 6:
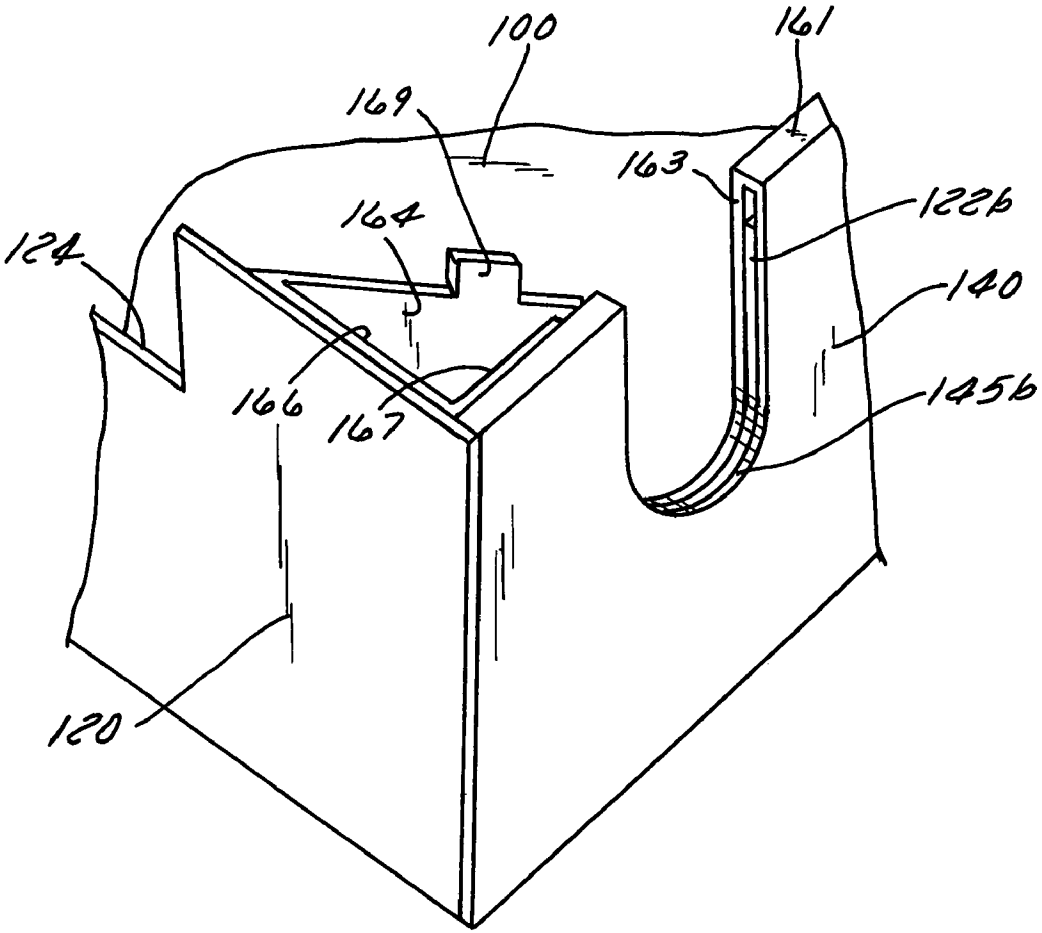
FIG. 6 is a partial perspective view of one corner of the bottom portion of the container according to a preferred embodiment of the present invention.

Referring now also to FIGS. 4-6, it can be seen that cutouts 115*a*, 135*a*, 155*a*; 125*a*, 135*b*, 155*b*; 115*b*, 115*b*, 145*a*, 165*a*; and, 125*b*, 145*b*, 165*b* each are aligned, respectively, so as to form openings through the endwalls. Interior flaps 154 of the first endwall inner panel 153 each are folded about one fold line 152 to extend diagonally from endwall inner panel 153 towards sidewalls 110, 120. Respective exterior flaps 156 are folded along another fold line 152 to lie against sidewalls 110, 120 and extend back towards endwall inner panel 153. Distal flaps 157 are folded along yet another fold line 152 to extend between (and be sandwiched by) endwall inner panel 153 and endwall outer panel 130. Flaps 154, 156, 157 cooperate to define corner support posts.

Similarly, interior flaps 164 of the second endwall inner panel 163 each are folded about one fold line 162 to extend diagonally from endwall inner panel 163 towards sidewalls 110, 120. Respective exterior flaps 166 are folded along another fold line 162 to lie against sidewalls 110, 120 and extend back towards endwall inner panel 163. Distal flaps 167 are folded along yet another fold line 162 to extend between (and be sandwiched by) endwall inner panel 163 and endwall outer panel 140. Flaps 164, 166, 167 cooperate to define corner support posts.

Upstanding tabs 159, 169 extend from endwall interior panels 150, 160, respectively, and preferably from interior flaps 154, 164 thereof, such that tabs 159, 169 project upwardly from corner regions of the container 1, the function of which will be described in greater detail below.

Figure 7:
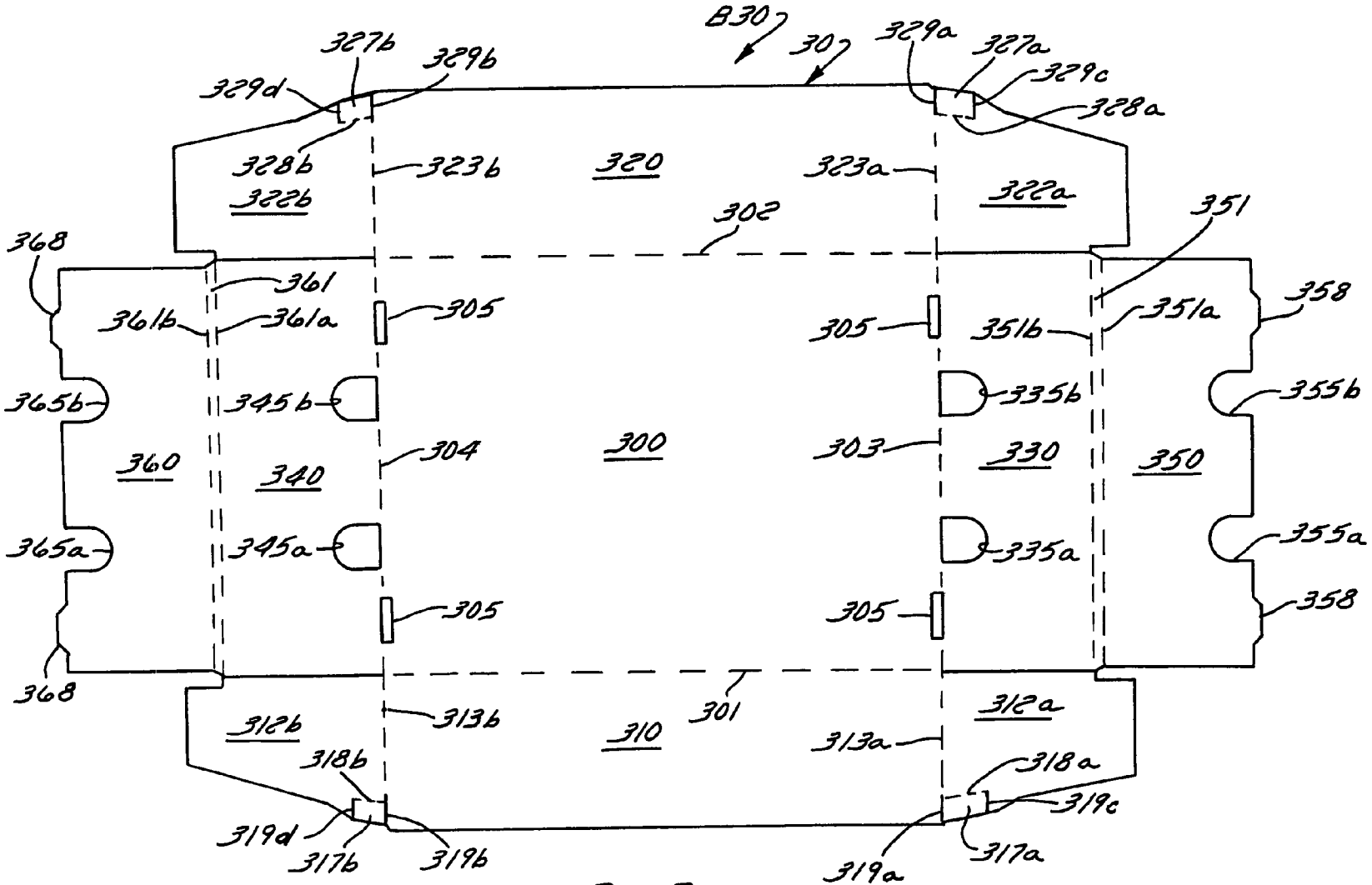
FIG. 7 is a plan view of a blank used to form a top portion of the container according to a preferred embodiment of the present invention.

Referring now to FIG. 7, a blank "B30" is shown adapted to be formed (such as by folding) into the cover 30 portion (FIG. 1) of the container 1 according to one specific preferred embodiment of the present invention. The blank "B30" is formed from a sheet of foldable material such as corrugated paperboard or the like and is generally rectangular in shape. Blank "B30" is divided by fold lines, score lines and slits to define panels which are foldable relative to one another (as described in greater detail herein) to form the cover 30 portion of the container 1.

Blank "B30" includes a bottom panel 300 generally centered thereon. A first sidewall panel 310 is foldably connected to a first side edge of the bottom panel 300 by a first side fold line 301. First sidewall panel 310 includes end flaps 312*a*, 312*b* foldably connected to distal ends of the first sidewall panel 310 by end flap fold lines 313*a*, 313*b*, respectively. End flaps 312*a*, 312*b* each include a lock tab 317*a*, 317*b*, respectively, defined by fold lines 318*a*, 318*b* and first cut lines 319*a*, 319*b* and second cut lines 319*c*, 319*d*, respectively.

A second sidewall panel 320 is foldably connected to a second side edge of the bottom panel 300 by a second side fold line 302. Second sidewall panel 320 includes end flaps 322*a*, 322*b* foldably connected to distal ends of the second sidewall panel 310 by end flap fold lines 323*a*, 323*b*, respectively. End flaps 322*a*, 322*b* each include a lock tab 327*a*, 327*b*, respectively, defined by fold lines 328*a*, 328*b* and first cut lines 329*a*, 329*b* and second cut lines 329*c*, 329*d*, respectively.

A first endwall outer panel 330 is foldably connected to a first end edge of the top panel 300 by a first end fold line 303. Cutouts 335*a*, 335*b* are provided through the first endwall outer panel 330 spaced along the first end fold line 303.

A first endwall inner panel 350 is foldably connected to a distal edge of the first endwall outer panel by a bridge segment 351, which in a preferred embodiment of the present invention is formed by a pair of generally parallel fold lines 351*a*, 351*b*. Cutouts 355*a*, 355*b* are provided through the first endwall inner panel 350 spaced along a distal edge thereof. Tabs 358 are provided spaced along the distal edge of the first endwall inner panel 350.

A second endwall outer panel 340 is foldably connected to a second end edge of the top panel 300 by a second end fold line 304. Cutouts 345*a*, 345*b* are provided through the second endwall outer panel 340 spaced along the first end fold line 304.

A second endwall inner panel 360 is foldably connected to a distal edge of the second endwall outer panel by a bridge segment 361, which in a preferred embodiment of the present invention is formed by a pair of generally parallel fold lines 361*a*, 361*b*. Cutouts 365*a*, 365*b* are provided through the second endwall inner panel 360 spaced along a distal edge thereof. Tabs 368 are provided spaced along the distal edge of the second endwall inner panel 360.

Slots 305 are provided in the top wall 300 along first and second end fold lines 303, 304, respectively.

Figure 8:
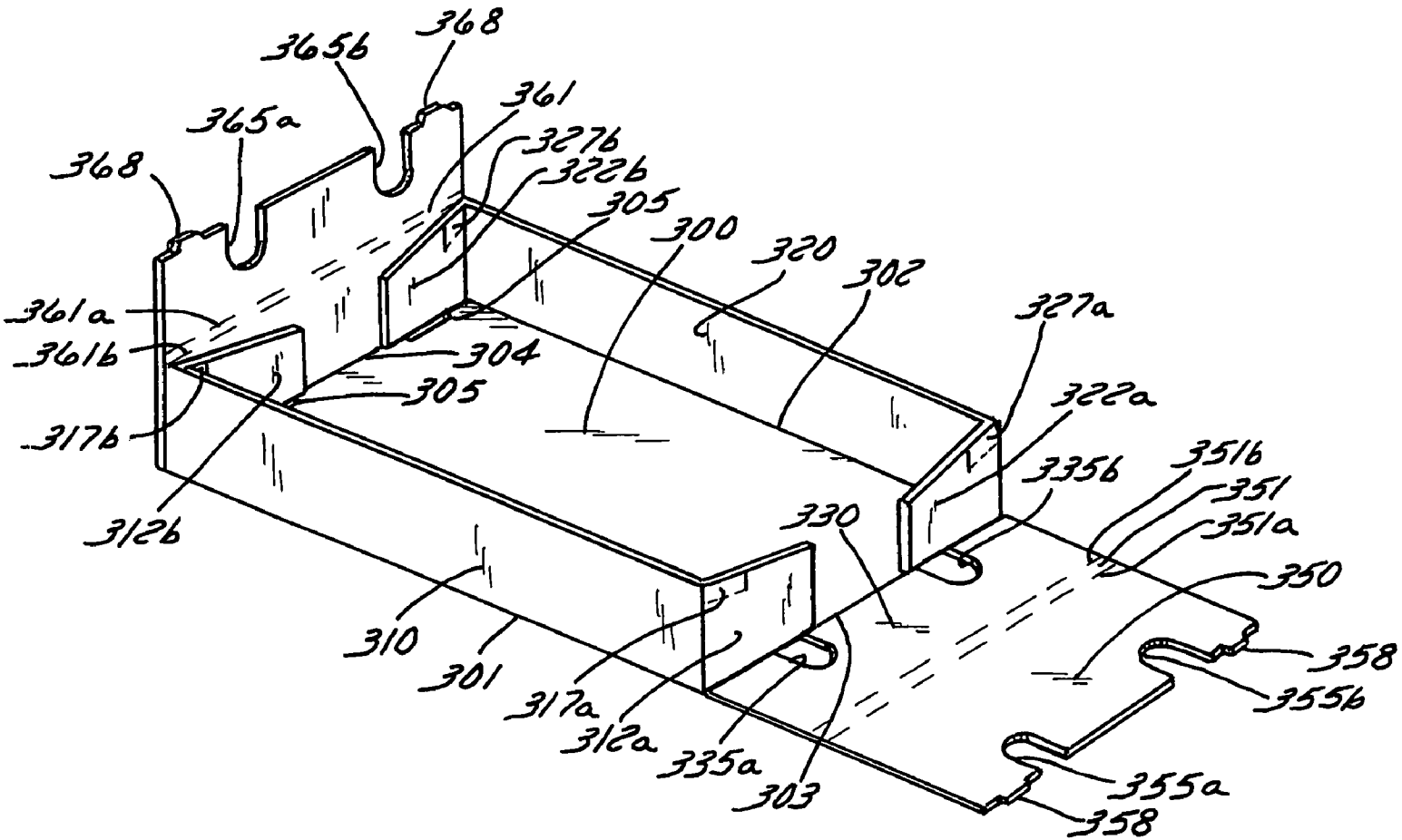
FIG. 8 is a perspective view of the blank shown in FIG. 7, wherein portions of the blank have been folded to partially form the top portion of the container according to a preferred embodiment of the present invention.

With reference now to FIG. 8, blank "B30" is folded to form cover 30 portion of the container 1 by folding sidewalls 310, 320 upwardly relative to fold lines 301, 302, respectively, such that sidewalls 310, 320 are generally perpendicular to top panel 300. Sidewall end flaps 312*a*, 312*b*, 322*a*, 322*b* are folded relative to sidewalls 310, 320, respectively, to form corners of the cover 30. Endwall outer panels 330, 340 are then folded upwardly relative to fold lines 303, 304, respectively, and endwall inner panels 350, 360 are folded inwardly over sidewall end flaps 312*a*, 322*a* and 312*b*, 322*b*, respectively. Tabs 358, 368 seat within slots 305 in the top wall 300 to retain endwall panels 330, 340, 350, 360 in place. Sidewall end flaps 312*a*, 322*a*, 312*b*, 322*b* are thereby held securely between endwall outer panels 330, 340 and endwall inner panels 350, 360, respectively.

Figure 9:
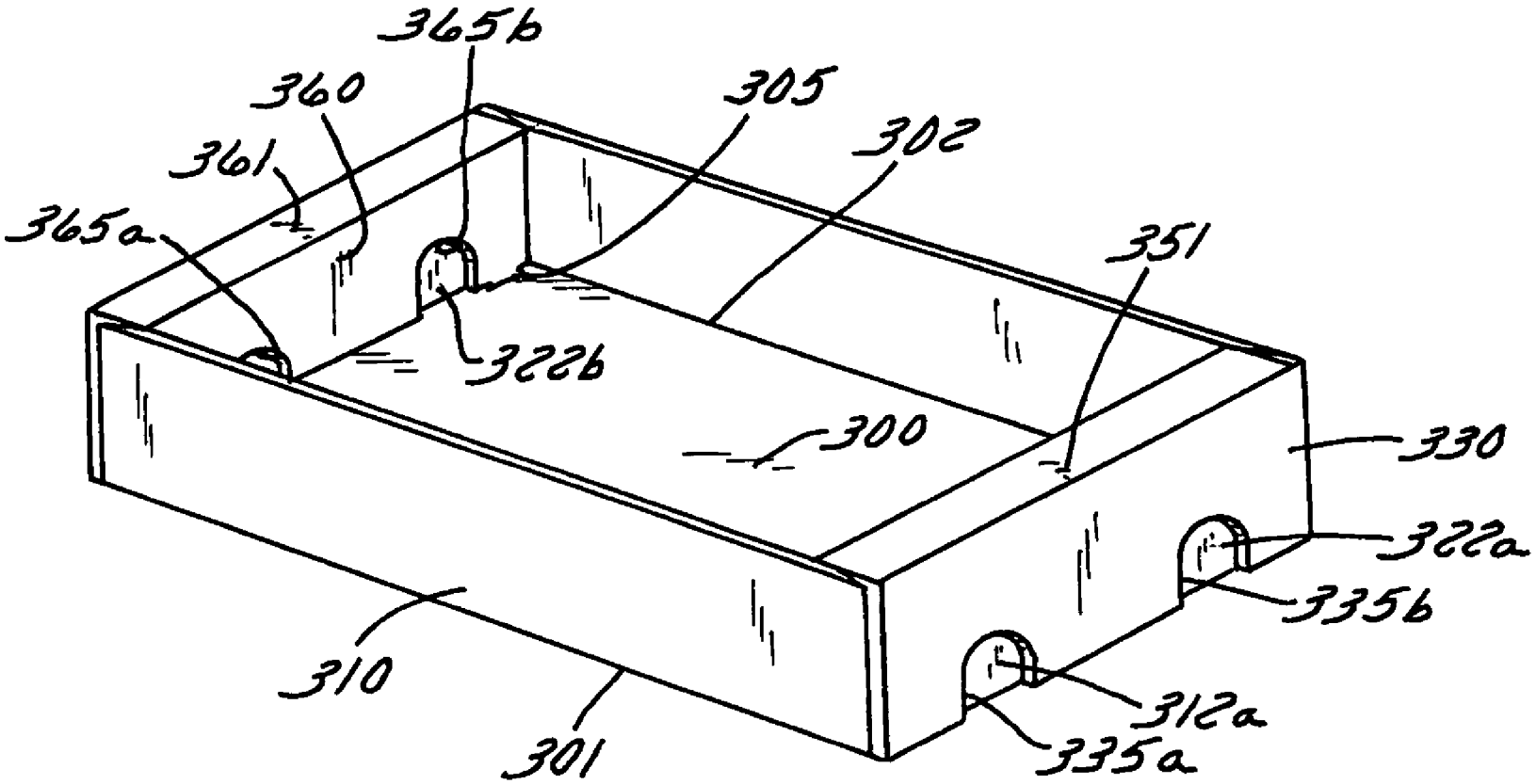
FIG. 9 is a perspective view of the blank shown in FIG. 7, wherein the blank has been folded to form the top portion of the container according to a preferred embodiment of the present invention.

With reference now also to FIG. 9, it can be seen that cutouts 335*a*, 355*a*; 335*b*, 355*b*; 345*a*, 365*a*; and, 345*b*, 365*b* each are aligned with one another (although blocked by sidewall end flaps 312*a*, 322*a*, 312*b*, 322*b*, respectively).

Figure 10:
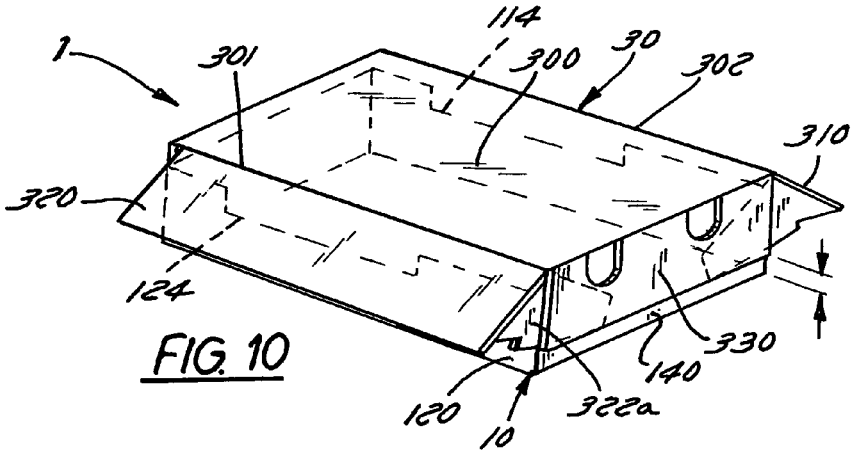
FIG. 10 is a perspective view of container according to a preferred embodiment of the present invention, wherein the top portion of the container is shown over the bottom portion and wherein sidewall flaps of the top portion are shown in an open position.

Referring to FIG. 10, cover 30 portion of the container 1 slides over the carton 10 portion such that their respective end wall cutouts are aligned. It will be appreciated by those of ordinary skill in the art that top panel 300 of the cover 30 will rest upon the upstanding tabs 159, 169 (FIG. 4) of the carton 10, thereby preventing (for the time-being) the cover 30 from fully telescoping over of the carton 10.

Figure 11:
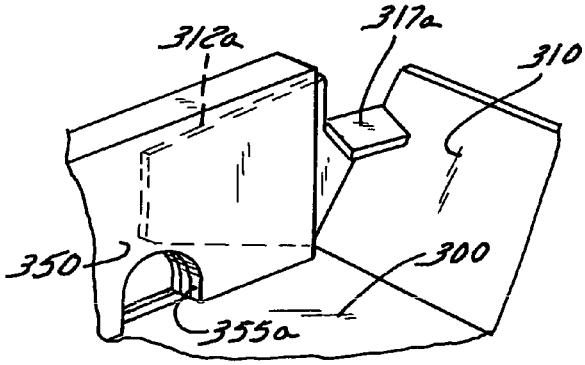
FIG. 11 is a partial perspective view of one corner of the top portion of the container according to a preferred embodiment of the present invention, wherein a lock tab portion of one sidewall flap is shown in a locked position; and, FIG. 12 is a perspective view of the container according to a preferred embodiment of the present invention, wherein the top portion of the container is shown over the bottom portion and wherein arrows are used to depict a closing force to be applied to the top portion.

Cover sidewalls 310, 320 each may pivot about fold lines 301, 302, respectively, to an open position, shown generally in FIG. 10. Sidewall end flaps 312*a*, 322*a* and 312*b*, 322*b* each are shaped to permit their sliding between inner and outer endwall panels 350, 330 and 360, 340, respectively, such that cover endwall cutouts 335*a*, 355*a*, 335*b*, 355*b*, 345*a*, 365*a*, 345*b* and 365*b* are in air flow communication with their respective carton cutouts (Figure) to permit blowing cold air (for refrigeration and/or freezing purposes) directly over the items stored within the container 1. Lock tabs 317*a*, 317*b*, 327*a*, 327*b* (which can be seen more clearly in FIGS. 8 and 11) can be folded inwardly about fold line 318*a*, 318*b*, 328*a*, 328*b*, respectively, to hold the sidewalls 310, 320 in the open position for an extended period of time, which is oftentimes required for freezing operations.

Similarly, while the sidewalls 310, 320 are in the open position, cold air is permitted to flow through the sides of the container 1, through cover sidewalls 310, 320 and carton sidewalls 110, 130, respectively, and more particularly, through the windows 114, 124 provided in the carton sidewalls 110, 120, respectively. Such an arrangement allows the cover 30 to be placed over the carton 10 after packing, thereby protecting the contents of the container 1 while it is being transported to the refrigeration/freezing facility, yet permits free exchange of air flow in to and out of the container during the refrigeration and/or freezing operation without requiring the cover 30 to be removed (and stored separately) from the carton 10 during the refrigeration and/or freezing operation.

Figure 12:
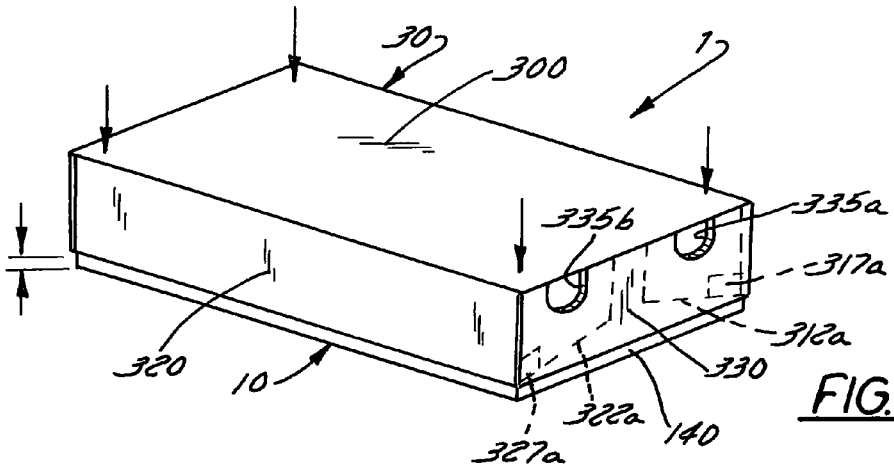

With reference to FIG. 12, after the refrigeration and/or freezing operation, the cover sidewalls 310, 320 are returned to a closed position by placing lock tabs 317*a*, 317*b*, 327*a*, 327*b* in their original orientation (in the plane of the sidewall end flaps 312*a*, 312*b*, 322*a*, 322*b*, respectively, and pivoting the cover sidewalls 310, 320 relative to fold lines 301, 302, respectively, so that cover sidewalls 310, 320 generally lie against carton sidewalls 110, 120, respectively. With the sidewalls 310, 320 in such an orientation, sidewall end flaps 312*a*, 312*b*, 322*a*, 322*b* slide back between cover endwall cutouts, thereby fully enclosing the items within the container 1. Cover sidewall end flaps 312*a*, 312*b*, 322*a*, 322*b* are frictionally held within carton endwalls so as to prevent inadvertent opening of the sidewalls while the container 1 is in transit. Alternatively, securing means such as tape, straps, adhesive or the like, may be used to hold cover sidewalls in a closed position, if necessary.

The container 1 is readied for shipping by a user applying a downward force on the cover 30, thereby causing the upstanding tabs 159, 169 (FIG. 4) to collapse and permitting the cover 30 to rest firmly on the sidewalls/endwalls of the carton 10. Tabs 159, 169 are sized to support the weight of the cover 30, generally, but to collapse upon applying some minimum force thereto. Of course, tabs 159, 169 are optional. As stated above with respect to holding cover sidewalls in their closed positions, securing means, such as tape, straps, adhesive or the like, may be used to prevent cover 30 from becoming disassociated from carton 10 or from cover 30 raising back up (relative to carton 10) due to upward bias of the folded-over 159, 169.

While the invention has been described and illustrated with reference to one or more preferred embodiments thereof, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

We claim:

1. A container, comprising: a carton having a bottom wall, sidewalls and endwalls, at least one of said carton endwalls having an opening; a cover having a top wall, sidewalls and endwalls sized to fit over said carton to define an interior space of said container, at least one of said cover endwalls having an opening therein, at least a portion of said cover endwall opening being aligned with at least a portion of said carton endwall opening when said cover is fit over said carton; wherein at least one of said cover sidewalls is pivotally movable between an open position and a closed position, when said cover is fit over said carton; and, wherein said at least one cover sidewall includes a flap that substantially covers both said cover endwall opening and said carton endwall opening so as to inhibit fluid flow in to and out of said interior space of said container when said at least one cover sidewall is in said closed position.

2. The container of claim 1, wherein said cover sidewall flap is substantially free of both said cover endwall opening and said carton endwall opening so as to permit fluid flow in to and out of said interior space of said container when said cover sidewall is in said open position.

3. The container of claim 1, wherein an opening is provided in each cover endwall, wherein an opening is provided in each carton endwall, and wherein each cover endwall opening aligns with one of said carton endwall openings when said cover is fit over said carton.

4. The container of claim 3, wherein a flap extends from each cover sidewall, and wherein each flap substantially covers one of said cover endwall openings and one of said carton endwall openings so as to inhibit fluid flow in to and out of said interior space of said container when said cover sidewall is in said closed position.

5. The container of claim 4, wherein each said cover sidewall flaps is substantially free of all said cover endwall openings and substantially free of all said carton endwall openings so as to permit fluid flow in to and out of said interior space of said container when said cover sidewall is in said open position.

6. The container of claim 1, further comprising a window in at least one of said carton sidewalls.

7. The container of claim 1, wherein at least one of said carton sidewalls is formed from a carton sidewall panel foldably connected to said bottom wall along a side fold line.

8. The container of claim 7, wherein said carton sidewall panel includes at least one end flap foldably connected to one end of said carton sidewall panel such that said end flap car, be aligned with an end fold line of said bottom wall when said carton sidewall panel is folded along said side fold line.

9. The container of claim 8, wherein at least one of said carton endwalls is formed from a carton endwall outer panel foldably connected to said bottom wall along said end fold line.

10. The container of claim 9, further comprising a carton endwall inner panel foldably connected to an outer edge of said carton endwall outer panel, said carton endwall inner panel being foldable over said carton sidewall panel end flap when said carton sidewall panel end flap is aligned with said end fold line of said bottom wall.

11. The container of claim 10, wherein said bottom wall includes at least one slot located near said end fold line and wherein said carton endwall inner panel includes at least one tab extending from an outer edge thereof, said carton endwall inner panel tab being received by said bottom wall slot when said carton endwall inner panel is folded over said carton sidewall panel end flap.

12. The container or claim 11, said carton endwall inner panel further comprising at least one interior flap extending from one end thereof and being foldable relative thereto for forming a support.

13. The container of claim 12, wherein said interior flap extends towards said carton sidewall panel.

14. The container of claim 12, wherein said carton endwall inner panel includes an upstanding tab for positioning said cover vertically above said carton when said cover is fit over said carton.

15. The container of claim 1, wherein said carton endwall includes an upstanding tab for positioning said cover vertically above said carton when said cover is fit over said carton.

16. The container of claim 15, wherein is upstanding tab is collapsible when a force is applied to said cover.

17. The container of claim 1, wherein at least one of said cover sidewalls is formed from a cover sidewall panel foldably connected to said top wall along a side fold line.

18. The container of claim 17, wherein said cover sidewall panel includes at least one end flap foldably connected to one end of said cover sidewall panel such that said end flap can be aligned with an end fold line of said top wall when said cover sidewall panel is folded along said side fold line.

19. The container of claim 18, wherein at least one of said cover endwalls is formed from a cover endwall outer panel foldably connected to said top wall along said end fold line.

20. The container of claim 19, further comprising a cover endwall inner panel foldably connected to an outer edge of said cover endwall outer panel, said cover endwall inner panel being foldable over said cover sidewall panel end flap when said cover sidewall panel end flap is aligned with said end fold line of said top wall.

21. The container of claim 20, wherein said top wall includes at least one slot located near said end fold line and wherein said cover endwall inner panel includes at least one tab extending from an outer edge thereof, said cover endwall inner panel tab being received by said top wall slot when said cover endwall inner panel is folded over said cover sidewall panel end flap.

22. The container of claim 21, said cover sidewall panel end flap further comprising a lock tab for positioning said sidewall in an open position.

23. The container of claim 19, wherein said endwall opening is defined by a cutout provided in said cover endwall outer panel.

24. The container of claim 23, wherein said endwall opening is further defined by a cutout provided in said cover endwall inner panel, said cutout of said cover endwall inner panel being substantially aligned with said cutout of said cover endwall outer panel.

25. The container of claim 23, wherein said cover sidewall panel end flap substantially covers said cutout of said cover endwall outer panel when said sidewall is in said closed position and wherein said cutout of said cover endwall outer panel is substantially free of said cover sidewall panel end flap when said sidewall is in said open position.

* * * * *